US011105079B1

(12) United States Patent
Woodring et al.

(10) Patent No.: US 11,105,079 B1
(45) Date of Patent: Aug. 31, 2021

(54) APPARATUS TO PREVENT A TOILET FROM BEING FLUSHED WHEN THE LID IS UP

(71) Applicant: Squawk On, LLC, Silver Spring, MD (US)

(72) Inventors: Cooper C. Woodring, Wakefield, RI (US); Perry J. Saidman, Miami Beach, FL (US)

(73) Assignee: Squawk On, LLC, Silver Spring, MD (US)

( * ) Notice: Subject to any disclaimer, the term of this patent is extended or adjusted under 35 U.S.C. 154(b) by 0 days.

(21) Appl. No.: 17/215,060

(22) Filed: Mar. 29, 2021

Related U.S. Application Data

(63) Continuation of application No. 17/029,950, filed on Sep. 23, 2020.

(51) Int. Cl.
*E03D 5/02* (2006.01)
*A47K 13/24* (2006.01)

(52) U.S. Cl.
CPC ..... *E03D 5/026* (2013.01); *A47K 13/245* (2013.01)

(58) Field of Classification Search
CPC ..... A47K 13/10; A47K 13/105; A47K 13/24; A47K 13/245; E03D 5/026
USPC ..... 4/246.1, 405, 661
See application file for complete search history.

(56) References Cited

U.S. PATENT DOCUMENTS 3,590,397 A * 7/1971 Akamatsu ..... E03D 5/04 4/313
4,122,563 A * 10/1978 Johnson ..... A47K 13/10 4/236
4,512,046 A * 4/1985 Riggle ..... A47K 13/24 4/246.1
4,519,105 A * 5/1985 Blanck ..... A47K 13/10 4/246.1
4,524,470 A 6/1985 Grenell
4,914,757 A 4/1990 Johnson
5,240,212 A * 8/1993 Brodie ..... A47K 13/245 248/214
5,319,810 A 6/1994 Metzger
5,349,703 A 9/1994 Mocilnikar et al.
5,400,446 A * 3/1995 Bloemer ..... E03D 5/04 4/250

(Continued)

FOREIGN PATENT DOCUMENTS

AU 2006201931 11/2006
WO 2017/073859 5/2017

OTHER PUBLICATIONS

WO-2017073859-A1 Translation (Year: 2020).
U.S. Appl. No. 17/029,950, filed Sep. 23, 2020 (unpublished).

*Primary Examiner* — David P Angwin
*Assistant Examiner* — William R Klotz
(74) *Attorney, Agent, or Firm* — Perry Saidman, LLC

(57) ABSTRACT

A toilet having a first-magnet secured to the terminal end of the toilet's flush-arm and a second-magnet secured to the toilet's lid such that when the lid is in its open or up position, the two magnets align preventing the flush-arm from rotating upward to cause the toilet to flush. Conversely, when the lid is down and the two magnets are separated, the flush-arm can be rotated upward causing the toilet to flush. In another example, a magnet-attracting component, such as iron, cobalt or nickel, can be substituted for one of the magnets. A kit for retrofitting an existing toilet is also disclosed.

24 Claims, 3 Drawing Sheets

(56) References Cited

U.S. PATENT DOCUMENTS

| | | | | |
|---|---|---|---|---|
| 5,410,766 | A | 5/1995 | Schumacher | |
| 5,435,016 | A * | 7/1995 | Smith | A47K 13/10 4/234 |
| 5,504,947 | A | 4/1996 | Robello et al. | |
| 5,592,700 | A | 1/1997 | Genesse | |
| 5,682,776 | A | 11/1997 | Burt | |
| 5,867,843 | A | 2/1999 | Robello et al. | |
| 6,775,855 | B1 | 8/2004 | Shannon | |
| 6,807,687 | B2 | 10/2004 | Marras | |
| D503,781 | S | 4/2005 | Matthews et al. | |
| 7,913,327 | B2 | 3/2011 | Meike et al. | |
| 9,015,869 | B2 | 4/2015 | Henderson | |
| 9,456,719 | B2 | 10/2016 | Foster et al. | |
| 9,506,232 | B2 | 11/2016 | Terry | |
| 9,545,177 | B1 | 1/2017 | Coven | |
| 10,428,505 | B2 | 10/2019 | Wang et al. | |
| 2015/0052671 | A1* | 2/2015 | Curtis | A47K 13/10 4/246.1 |
| 2021/0115654 | A1* | 4/2021 | Choi | E03D 5/04 |

* cited by examiner

APPARATUS TO PREVENT A TOILET FROM BEING FLUSHED WHEN THE LID IS UP

CROSS-REFERENCE TO RELATED APPLICATION

This application is a continuation of prior pending U.S. application Ser. No. 17/029,950, filed Sep. 23, 2020, the entirety of which is expressly incorporated herein by reference.

BACKGROUND OF THE DISCLOSURE

Xiandong Liu and Ji-Xiang Wang, both physicists and researchers at Yangzhou University in China discovered in July 2020 that "flushing a toilet creates a plume of coronavirus-laden particles, which are flung into the air by the watery vortex inside a toilet bowl".

Both are co-authors of the August 2020 Journal, "The Physics of Fluids". In their article, the co-authors explain, "The flushing process can lift the virus out of the toilet and cause cross-infection among people". Later in the same article, they explained it in yet another way, "Flushing creates in the air above the toilet pan a vortex which encourages massive upward transport of virus particles". They end the article with, "Closing the lid on the toilet before flushing would prevent the transmission of the particles".

National Geographic says, "One of the most effective ways to keep potentially infected aerosols of any kind from flying into the air is to simply close the toilet's lid before flushing". MIT Medical School and many other experts agree that closing the lid before flushing is the best solution, and MIT adds that if it is a public toilet with no lid, then "flush and rush" as fast as you can.

The close-the-lid-before-flushing must be foolproof by being the only way the toilet can be flushed. The occupant cannot be relied on to close the lid before flushing.

SUMMARY OF THE DISCLOSURE

In today's toilet when the external flush-handle is rotated downward, the internal flush-arm will be rotated upward pulling a chain connected to a rubber stopper and causing the toilet to flush. In this disclosure, a small but powerful magnet is attached to the end of the flush-arm in close proximity to the interior surface of the ceramic water tank's front wall. A second similar magnet is attached to the toilet's lid. When the toilet's lid is rotated up, the two magnets are closely aligned, preventing the flush-arm from being rotated upwardly and preventing the toilet from being flushed. When the lid is closed and the two magnets are separated, then and only then, can the toilet be flushed since the flush-arm would then be free to be rotated upwardly.

DETAILED DESCRIPTION OF THE DISCLOSURE

Figure 1:
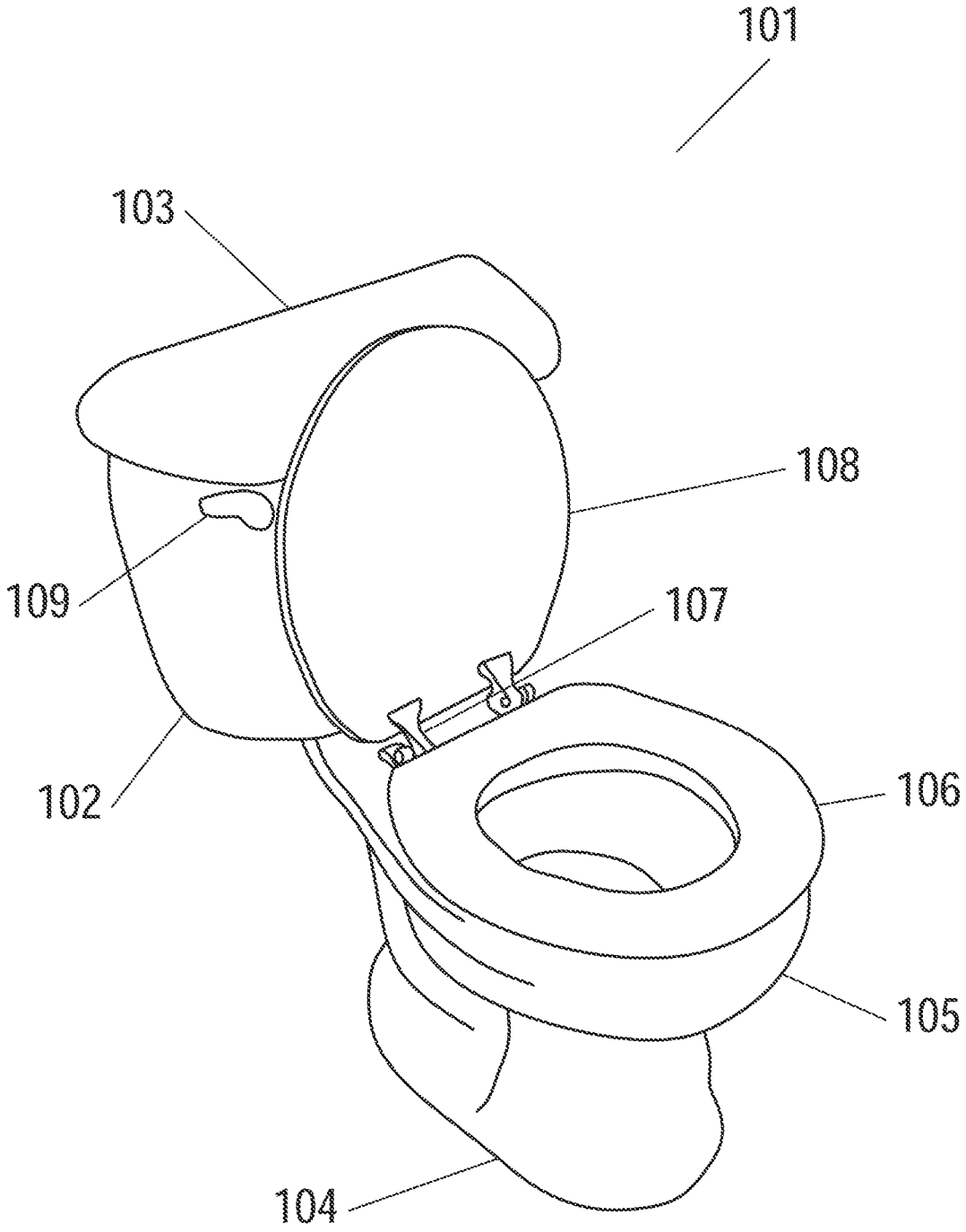
FIG. 1 is a perspective view of a typical toilet with the toilet's visible component parts identified.

Flushing today's toilet requires downwardly rotating an external flush-handle, which in turn causes an internally located side-to-side flush-arm to rotate upwardly. The flush-arm lifts an adjustable length chain that in turn lifts a rubber stopper, allowing the water in the water tank to be rapidly released into the toilet's bowl, causing the bowl's contents to be forced down the sewer pipe.

When the standard 1.6-gallon contents of the bowl rush down the sewer pipe, a similar volume of air is sucked into the toilet's bowl to replace the prior volume of water. The air enters the bowl through the openings between the lid, seat and bowl. This is actually helpful by causing some of the COVID-19 contaminated air to also be carried down the sewer pipe.

When the water tank is almost empty, the rubber stopper resets itself allowing new water to start slowly refilling the water tank until a float shuts off the incoming water when the water has reached an adjustable pre-determined level. Now, the toilet has completed its full flush cycle and is standing-by for another identical cycle.

In this disclosure, most of the mechanism described above will remain basically unchanged, however the toilet's flush-arm and lid are revised as follows. Two similar magnets will ensure that the toilet will not flush when the lid is up. One magnet is attached near the end of the flush-arm the other magnet is attached to the toilet's lid. When the lid is up and the magnets are aligned in close proximity to one another, the toilet will not flush. When the lid is down and the magnets are misaligned, the toilet will flush.

When the lid is up, the close alignment of the flush-arm's magnet with the lid's magnet will not allow the flush-arm to rotate upwardly, as it must in order for the toilet to flush. Closing the lid separates the magnets and allows the flush-arm to freely rotate upwardly when the flush-handle is manually rotated downwardly allowing the toilet to flush. When the lid is closed, the toilet will not automatically flush; a person will still have to manually rotate the flush handle downwardly to flush the toilet.

The magnets can be, for example, of the powerful Neodymium type, about the size of a 5¢ coin, or possibly the size of a 25¢ coin if the water tank's ceramic wall thickness is above normal, and/or if the lid and front wall of the water tank are not substantially parallel to one another when the lid is up. In manufacturing a new toilet, the magnets can be insert-injection molded into the flush-arm and into the toilet's lid behind a very thin plastic wall on the side of the flush-arm that faces the water tank's front surface and behind the lid's surface that faces the water tank when the lid is up. This helps to minimize the distance between the facing surfaces of the two magnets so their attraction one to another will be stronger. It will also provide a more acceptable visual solution. In a retrofit installation, the magnets may also be exposed such that they could be individually attached and replaced if necessary. The retrofit parts may be packaged and sold as a DIY kit.

Referring first to FIG. 1, a typical residential toilet 101 is shown. The toilet 101 has externally visible parts, such as a water tank 102, a water tank lid 103, a base 104, a bowl 105, a seat 106, lid and seat hinges 107, a lid 108 and a flush-handle 109.

Figure 2:
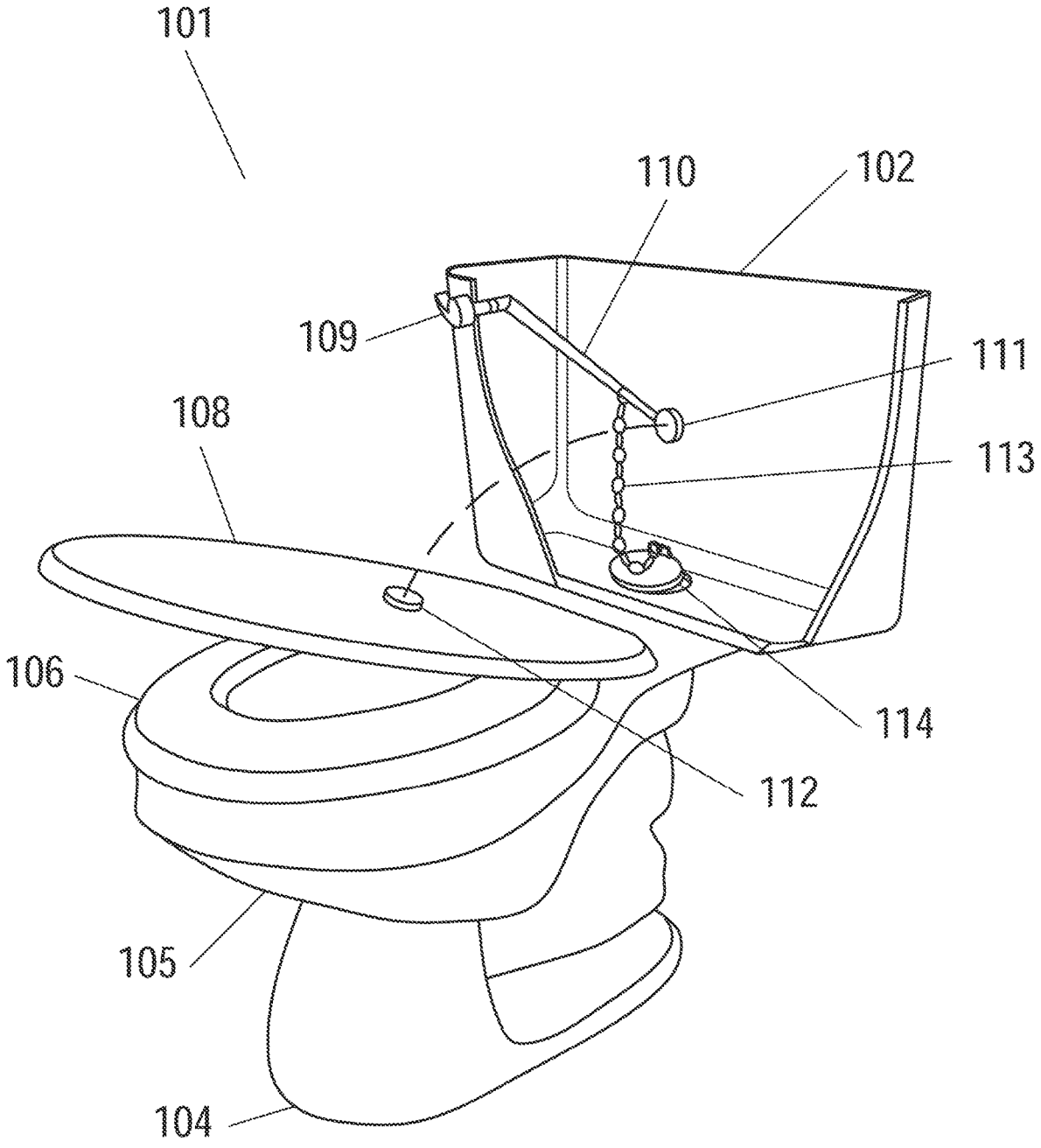
FIG. 2 is another perspective view of a typical toilet with a portion of the water tank having been cut away and the lid separated from the tank.

Referring now to FIG. 2, the interior of water tank 102 is shown. Exterior to water tank 102 is flush-handle 109 and a flush-arm 110. When flush-handle 109 is rotated downwardly, flush-arm 110 is rotated upwardly causing chain 113 to lift stopper 114 causing toilet 101 to flush. Flush-arm 110 has a first-magnet 111 secured near its terminal end. The greater the distance between flush-handle 109 and first-magnet 111, the greater the downward force on flush-handle 109 will be required to cause the first-magnet 111 to move upwardly. FIG. 2 also shows a second-magnet 112 secured to lid 108 of toilet 101. While second-magnet 112 is shown mounted to the exterior surface of lid 108, it may be mounted internally as described above. FIG. 2 illustrates the situation where lid 108 is distanced from tank 102 such that magnets 111 and 112 are misaligned and flush-arm 110 is therefore free to move upwardly to flush the toilet.

When the flush-arm 110 is at rest or is in its "parked" position, the first-magnet 111 will align with the second-magnet 112 when the lid 108 is rotated to its upright position. FIG. 2 also shows how the second-magnet 112 can be rotated through lid 108's arc until it aligns with the first-magnet 111.

Figure 3:
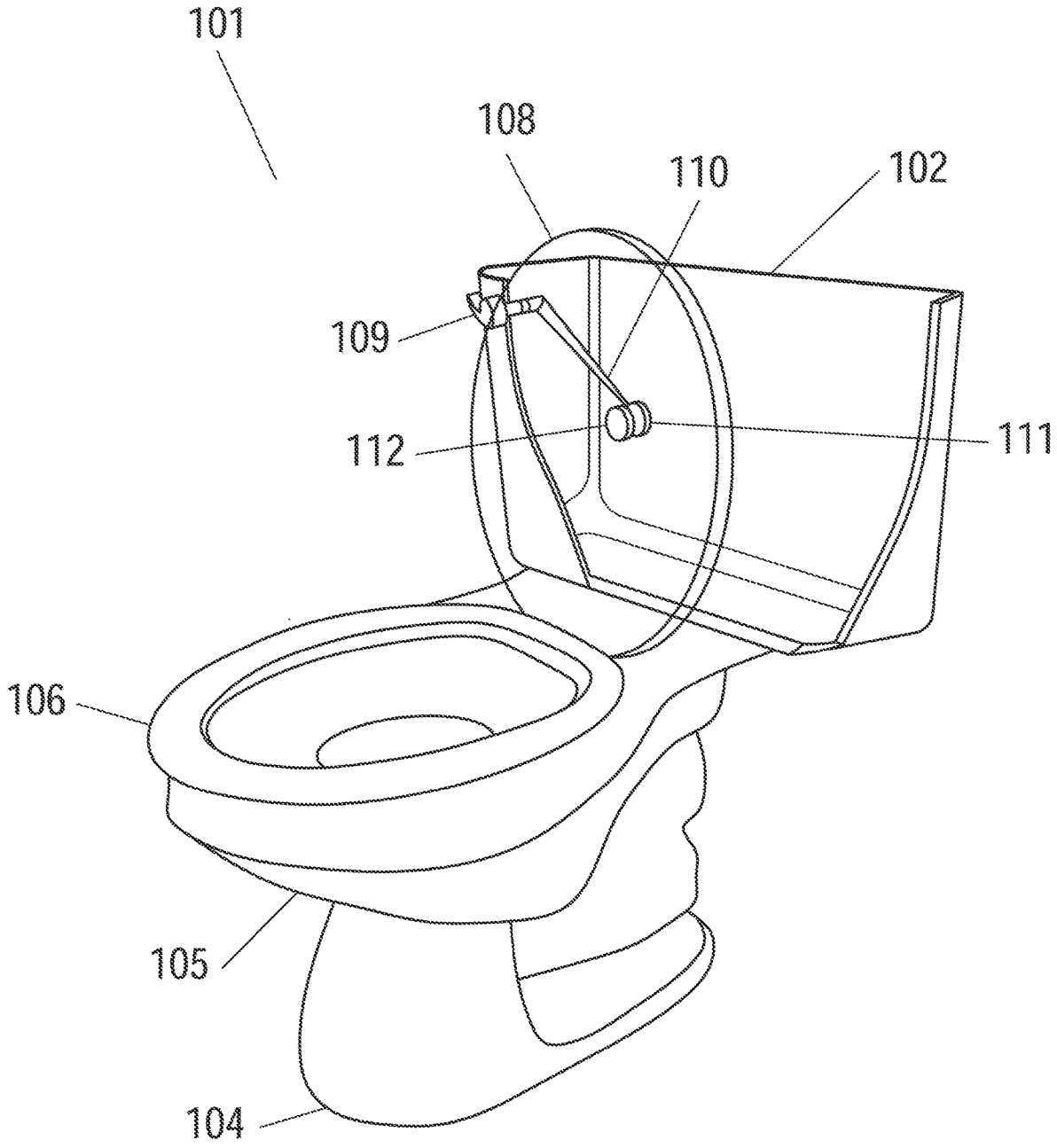
FIG. 3 shows the toilet of FIG. 2 with the lid adjacent the tank.

FIG. 3 shows toilet 101 with the front wall of water tank 102 having been cut away for ease in explanation. FIG. 3 also shows lid 108 as being transparent for further ease in explanation. Lid 108 is shown in a full upright position such that second-magnet 112 is aligned with first-magnet 111 thereby preventing toilet 101 from being flushed. When lid 108 is closed, second-magnet 112 will be separated from first-magnet 111 such that flush-arm 110 may be moved upwardly so that toilet 101 can be manually flushed.

In addition to being sold as a new and safer toilet, the present disclosure may also be sold as a kit that a home-owner or a plumber can install in an existing toilet. The kit would contain first-magnet 111, second-magnet 112 and optionally a replacement flush-arm 110, along with optional methods of securing first and second-magnets 111 and 112 to lid 108 and flush-arm 110. One such option would be to include a small tube of epoxy in the kit along with instructions on how to position second-magnet 112 on lid 108 to assure that the magnets align when the lid 108 is in the up position. Alternately, the kit's optional replacement flush-arm 110 may be provided with first-magnet 111 already installed. Then an installer has only to determine proper place of alignment of second-magnet 112 with first-magnet 111 when lid 108 is in its full upright position. Second-magnet 112 could be mounted on the underside of the lid 108 for aesthetic reasons, although it could be mounted on the topside of lid 108 if desired, or for possibly improved operation.

In the foregoing, the magnets 111 and 112 are described as individual magnets. It is understood, however, that the magnets could be magnetic portions integrally formed with appropriate elements of the toilet. For example, the free end of the flush-arm could consist of an integrally formed magnetic portion rather than a separately formed magnet. And as noted above, a magnetic portion can be insert-injection molded into the lid. Further, the magnets or magnetic portions need not be "button" magnets as illustrated, but may be any shape and size, as long as they are of sufficient strength to achieve the objects of this disclosure.

It is also possible to use only one magnet rather than two magnets. More particularly, one magnet could be used on one component, either the lid or the flush-arm, while using a magnet-attracting material, such as iron, cobalt or nickel, or the other component. In other words, a magnet of suitable strength could be secured to or within the lid, and the end of the flush-arm having or being integrally formed therewith a ferrous material of suitable size that will attract the magnet portion in the lid to achieve the objects described above. Or vice versa, a magnetic portion could be secured to the end of the flush-arm, and the lid could have a ferrous or other magnet-attracting material attached thereto.

We claim:

1. Apparatus for preventing the flushing of a toilet, wherein the toilet includes a toilet bowl, a water tank, a flush-arm located inside said water tank and having a first end, said first end of said flush-arm being in a static position when said toilet is not being flushed and a raised position when said toilet is being flushed, a flush-handle connected to said flush-arm for manually moving said flush-arm from said static position to said raised position, and a lid movable between a first position adjacent said tank, and a second position covering said bowl, said lid having an outside surface and an inside surface, comprising:

a first magnetic portion located at said first end of said flush-arm;

a second magnetic portion secured to said lid;

said first and second magnetic portions being in proximity with one another when said lid is in said first position to prevent said flush-arm from moving from said static position;

said first and second magnetic portions becoming misaligned only when said lid is moving towards said second position only after which said flush-arm can move from said static position to said raised position by manually moving said flush-handle causing said toilet to flush;

said toilet being manually flushed only after said second magnetic portion becomes misaligned with said first magnetic portion.

2. The apparatus of claim 1, wherein said first magnetic portion comprises a first magnet secured to said first end of said flush-arm.

3. The apparatus of claim 1, wherein said second magnetic portion comprises a second magnet secured to said lid.

4. The apparatus of claim 1, wherein said second magnetic portion is integral with said lid.

5. The apparatus of claim 3, wherein said second magnet is secured to said outside surface of said lid.

6. The apparatus of claim 3, wherein said second magnet is secured to said inside surface of said lid.

7. A kit for preventing a toilet having a water tank from being flushed by preventing a flush-arm of said toilet located inside said water tank from being moved when a lid of said toilet is in proximity to said water tank, said lid having an inside surface and an outside surface, comprising:

a first magnetic portion located inside said water tank and adapted to be secured near an end of said flush-arm; and a second magnetic portion adapted to be secured to said lid such that when said first and second magnetic portions are aligned said flush-arm cannot be moved;

said first and second magnetic portions adapted to become misaligned when said lid is being closed only after which said flush-arm may be moved.

8. The kit of claim 7 wherein said first and second magnetic portions comprise individual first and second magnets, respectively.

9. The kit of claim 8, further comprising a tube of adhesive for attaching said first magnet to said flush-arm and said second magnet to said lid.

10. The kit of claim 7, further comprising a replacement flush-arm having said first magnetic portion secured near an end thereof.

11. The kit of claim 10, wherein said first magnetic portion is formed integrally with said replacement flush-arm.

12. The kit of claim 9, wherein said second magnet is attached to said outside surface of said lid.

13. The kit of claim 9, wherein said second magnet is attached to said inside surface of said lid.

14. Apparatus for controlling the flushing of a toilet, wherein the toilet includes a toilet bowl, a water tank, a flush-arm located inside said water tank and having a first end, said first end of said flush-arm being in a static position when said toilet is not being flushed and a raised position when said toilet is being flushed, a flush-handle connected to said flush-arm for manually moving said flush arm to said raised position, and a lid movable between a first position adjacent said tank, and a second position covering said bowl, comprising:

first and second components, one of said components comprising a magnetic portion and the other of said components comprising a magnet-attraction portion;

said first component located at said first end of said flush-arm;

said second component secured to said lid;

said first and second components being in proximity with one another when said lid is in said first position to prevent said flush-arm from moving from said static position;

said first and second components becoming misaligned only when said lid is moving towards said second position only after which said flush-arm can move to said raised position by manually moving said flush-handle causing said toilet to flush;

said toilet can be manually flushed only after said first and second components become misaligned.

15. The apparatus of claim 14, wherein said first component comprises a magnet secured to said first end of said flush-arm.

16. The apparatus of claim 15, wherein said second component comprises a magnet-attracting component secured to said lid.

17. The apparatus of claim 14, wherein said first component comprises a magnet-attracting component secured to said first end of said flush-arm.

18. The apparatus of claim 17, wherein said second component comprises a magnet secured to said lid.

19. A kit for preventing a toilet having a water tank from being flushed by preventing a flush-arm of said toilet located inside said water tank from being moved when a lid of said toilet is in proximity to said water tank, comprising:

a magnetic component and a magnetic-attracting component;

one of said components located inside said water tank and adapted to be secured near an end of said flush-arm; and the other of said components adapted to be secured to said lid such that when said components are aligned said flush-arm cannot be moved said first and second components adapted to become misaligned when said lid is being closed only after which said flush-arm may be moved.

20. The kit of claim 19, further comprising a replacement flush-arm having one of said components secured near said end thereof.

21. The apparatus of claim 1, wherein said first and second magnetic portions do not touch each other when they are in proximity with one another.

22. The apparatus of claim 14, wherein said first and second components do not touch each other when they are in proximity with one another.

23. The apparatus of claim 1, wherein said first magnetic portion is integral with said flush-arm.

24. The apparatus of claim 14, wherein said first component is integral with said flush-arm.

* * * * *